United States Patent [19]

Fraser

[11] 4,223,182

[45] Sep. 16, 1980

[54] TRANSMISSION OF SIGNALS WITH PRIVACY

[75] Inventor: John M. Fraser, Brooklyn, N.Y.

[73] Assignee: Bell Telephone Laboratories, Incorporated, Murray Hill, N.J.

[21] Appl. No.: 556,031

[22] Filed: Sep. 27, 1944

[51] Int. Cl.[3] ..... H04K 1/00

[52] U.S. Cl. ..... 179/1.5 R; 178/22

[58] Field of Search ..... 179/1.5, 1.5 R; 250/6.6; 178/22

[56] References Cited

U.S. PATENT DOCUMENTS

| | | | |
|---|---|---|---|
| 2,301,223 | 11/1942 | Mitchell | 179/1.5 R |
| 2,364,210 | 12/1944 | Guanella | 179/1.5 R |
| 2,401,888 | 6/1946 | Smith | 179/1.5 R |
| 3,976,839 | 8/1976 | Miller | 179/1.5 R |
| 3,979,558 | 9/1976 | Peterson | 179/1.5 R |

*Primary Examiner*—Howard A. Birmiel

*Attorney, Agent, or Firm*—William L. Keefauver

EXEMPLARY CLAIM

In a speech transmission system, a first privacy apparatus for making reversible alterations in speech message waves for rendering unauthorized reception of the message difficult, a second privacy apparatus for making a different kind of reversible alterations in the speech message waves for increasing the difficulty of unauthorized reception of the message, a common coding mechanism for controlling the alterations made in both privacy apparatuses, said coder supplying control potentials to the first of said privacy apparatuses, and means in said first privacy apparatus for translating said control potentials into control potentials of different character for controlling said second privacy apparatus.

7 Claims, 3 Drawing Figures

TRANSMISSION OF SIGNALS WITH PRIVACY

The present invention relates to the transmission of signals with privacy and more particularly to apparatus for effecting different alterations in signals in succession to render their reception by unauthorized persons more difficult than would be the case if either type of alteration were used by itself.

The invention is particularly concerned with transmission with privacy or secrecy in which the different kinds of alterations introduced in the signals by the respective privacy systems are changed from time to time and in which the changes are effected in an irregular manner so as to prevent any indication being given in the transmitted wave of the character of coding used in the first privacy system, even where the alterations last made before transmission might be discoverable.

The general object of the invention is to achieve in signal transmission a high degree of security against unauthorized receipt of messages.

A feature of the invention comprises the use of a common coding control means for governing the code changes made in two privacy systems operating in tandem.

In a specific embodiment to be more fully described hereinafter, a first privacy equipment can be variably controlled by a coder mechanism supplied with control currents of highly irregular character, and the second privacy equipment can be variably controlled over circuit paths that pass through said coder mechanism and are acted on by the coder mechanism to produce a highly irregular type of control for the second privacy equipment. The action of the coder on the control paths for the second privacy equipment renders such control so irregular and unsystematic as to give substantially no clue in the transmitted currents as to the coding scheme used in the first privacy equipment.

Such a system is disclosed in the accompanying drawing in which.

Figures 1, 2:
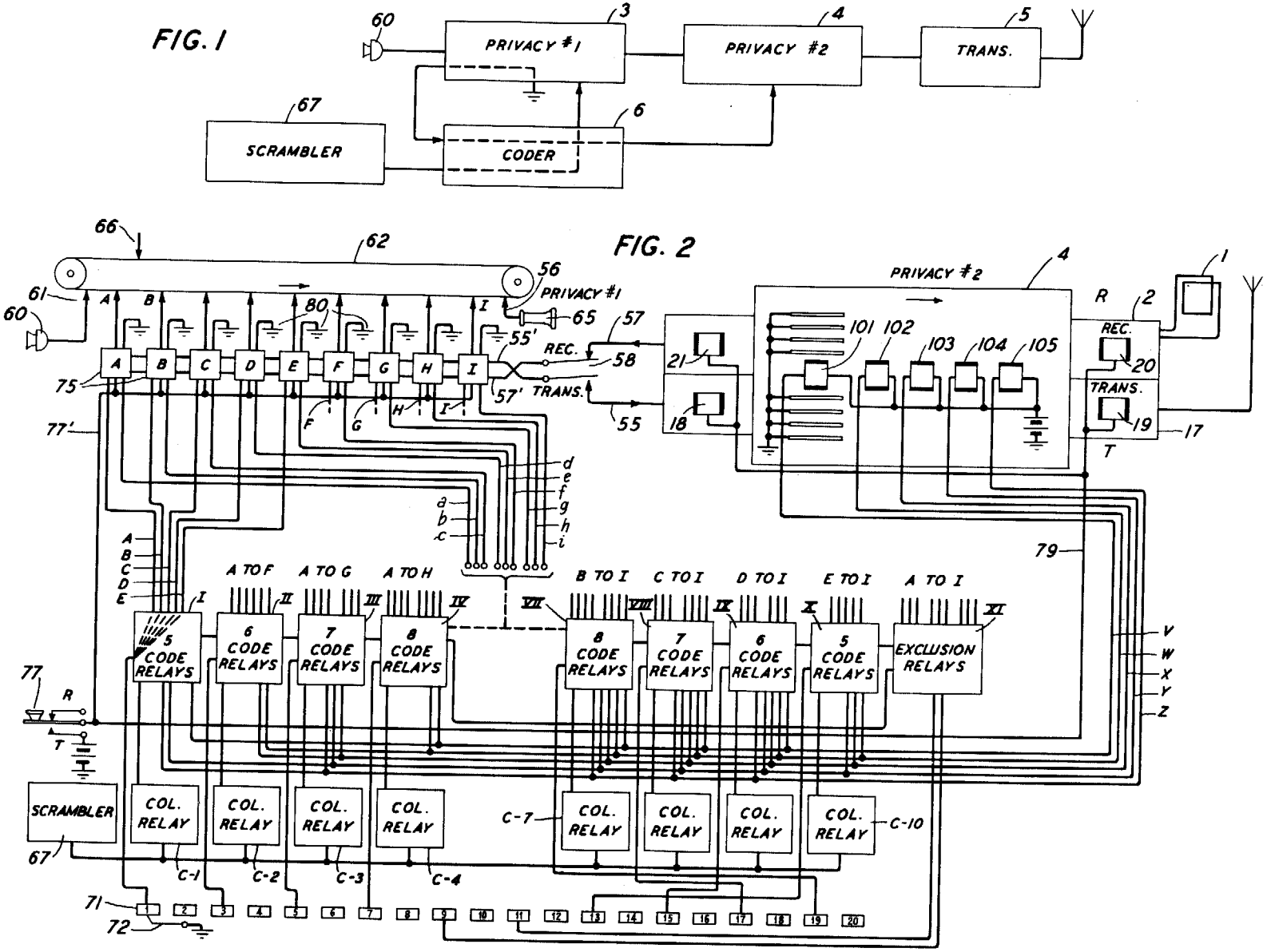
FIG. 1 is a block schematic diagram showing the manner in which the main parts of a system according to the invention are associated.
FIG. 2 is a schematic diagram mostly in block form illustrating in further detail the nature of the two privacy systems and their manner of association according to the invention.

Referring to FIG. 1, speech spoken into the microphone 60 passes through a first privacy system shown at 3 and thence through a second privacy system shown at 4, after which the secret speech currents are applied to any suitable transmission channel such as radio transmitter 5. Each of the privacy systems 3 and 4 is of the type which is capable of having its scheme of coding continuously changed under control of suitable circuits. The coder 6 is provided for this purpose and is in turn controlled by the scrambler 67. The scrambler 67 generates the code in the form of control currents that are sent into the coder 6 in a continuous sequence and with the proper time relations. The coder 6 receives these control currents and in response to them sets up certain control circuits for immediately varying the scheme of coding used in the first privacy system 3. As a result of the changes in the scheme of coding in privacy system 3, grounds are projected back into the coder 6 where they are routed over different paths depending upon the setting of the coder and are sent into the second privacy system 4 for effecting changes in the scheme of coding used in the latter system.

The second privacy system 4 serves not only to introduce further transformations into the transmitted currents to render them more secret but also to conceal from an outsider the code changes introduced into the first privacy system 3. This latter object is furthered by the connection of the control circuits of the second privacy through variable elements in the first privacy and through other variable elements in the coder 6 as will be more fully apparent as the description proceeds.

While the invention in its broadest aspects is not limited to particular types of privacy systems, it is illustrated in FIG. 2 as embodied in a system in which the first privacy is of the time delay type and the second privacy is of the frequency shifted band type. It is assumed in the present disclosure that the first privacy system is the same as that disclosed and claimed in Busch-Cahill-Myers application Ser. No. 484,362, filed Apr. 24, 1943, now U.S. Pat. No. 3,012,099, supplemented by the improvement features disclosed and claimed in D. Mitchell application Ser. No. 484,363, filed Apr. 24, 1943, now U.S. Pat. No. 3,012,100 and that the second privacy system is the same as that disclosed in United States patent to Chesnut, Fisher and Sanial U.S. Pat. No. 1,829,783, Nov. 3, 1931, except for certain simplifications made in the latter as will be pointed out in detail hereinafter. In the interest of brevity, only such disclosure of these different types of privacy systems as is deemed necessary to give an adequate understanding of the present invention is made in this application and reference may be had to the foregoing applications and patent for a more detailed disclosure of the privacy systems themselves.

The first privacy system depends upon the relative amounts of delay introduced into different successive portions of the speech waves so as to cause the waves to be transmitted in an abnormal time sequence. The delay medium is disclosed as a telegraphone tape 62 continuously driven in the direction of the arrow over suitable pulleys. A recording head represented by the arrow 61 is energized by speech currents from microphone 60 and makes a record on the tape. Nine recording heads A to I are shown equally spaced along the tape for picking up the recorded speech waves and transmitting them into the outgoing circuit 55 to the input of the second privacy system. These reproducing heads A to I are arranged to be switched into circuit one at a time in various manners to produce output currents having various abnormal arrangements of the speech current fragments and the coding in any particular instance depends upon which reproducing heads are used and in what order. An erasing head is shown at 66.

These reproducing heads A to I also serve as recording heads when speech is to be received and decoded. The received coded speech is recorded fragment by fragment on the tape 62 by the different heads in such manner that as the tape passes the receiving head 56 the speech fragments occur in normal order and are received as intelligible speech in the receiver 65. While, for simplicity of showing, a single erasing head is indicated at 66, it would be desirable in practice to follow the detailed disclosure of the Mitchell application referred to and to use head 56 to erase when transmitting and head 61 to erase when receiving, switching these heads under control of the push-to-talk key 77.

A rotary distributor is shown at the bottom of the figure in developed form with its segments in line and a grounded brush 72 sweeps over these distributor segments in timed relation with the travel of the tape 62. As the brush 72 makes contact with segment No. 1, one of the heads A to E is switched into circuit for transmitting or receiving, as the case may be, the selection of the particular head depending upon the energization of one of the five code relays in the box I. This is indicated diagrammatically by showing the lead from commutator segment No. 1 as having five different potential paths through the box I and as emerging on one of the five leads A to E extending to the corresponding switching circuits 75 which are individually associated with the heads A to E. This means that during distributor time 1 any one of the heads A to E can be selected for use. Similarly, (and passing over the even-numbered distributor segments for the moment) when brush 72 passes over distributor segment 3 a circuit can be closed through one of six code relays in box II to switch into circuit any one of the heads A to F. In distributor time 5 one of seven code relays in box III can be selected to cause one of the heads A to G to be switched into circuit and in distributor time 7 any one of the heads A to H can be selected by one of the eight relays in box IV.

Passing over to distributor time 13, it is seen from the drawing that one of the five code relays in box X can be selected to switch one of the heads E to I into circuit. In the succeeding odd-numbered distributor times the relays in boxes IX, VIII and VII are actuated in that order to switch the corresponding heads into circuit as designated by the letters adjacent the boxes. This same scheme of selection could be followed also for the remaining distributor segments 9 and 11 but as pointed out in the Busch-Cahill-Myers disclosure an economy of apparatus is secured by using the exclusion relays in box XI to select one of the heads A to I in distributor time 9 and also to select one of these heads in distributor time 11. This economy of apparatus is feasible since only two possible selections of heads remain after code relays have been set up in each of the eight boxes containing code relays, the two remaining possible selections being already determined by the exclusion relays of which eight relays are actuated and locked by the time the eight code relays, one per box, have been actuated. It only remains to determine which of these two remaining possible selections is to be made in distributor time 9 and which in distributor time 11. This determination is made by transfer contacts on the exclusion relays as disclosed in the Busch-Cahill-Myers disclosure.

So far as the present invention is concerned, it would be sufficient to assume a ten-segment distributor comprising only the odd numbers of segments. If it is desired, however, to use an interlace code, a second complement of code relays similar to those shown in this figure can be furnished and wired to the even-numbered segments, such an arrangement being disclosed in the Busch-Cahill-Myers application. If a system of interlace code relays is used, they will be supplied also with their own set of exclusion relays, an interlace scrambler and duplicate control circuits.

The scrambler 67 determines the selection of the particular code relay in each of the eight boxes with the help of the exclusion relays. From the standpoint of control and use, the code relays are divided into two groups, the first group consisting of those in the boxes I to IV and the second group consisting of those in the boxes VII to X. The relays in the second group are individually selected and locked while the brush 72 is traversing distributor segments 1 to 9. During this time, code relays in boxes I to IV are in locked position, having been selected and actuated during the previous half cycle of the distributor. Before the brush reaches segment 11, a relay in each of the boxes VII to X has been selected and locked in readiness for use. At this time also the code relays in the first group are released and reselected to set up a new code.

In setting up a code on the code relays, scrambler 67 is operatively associated through a column relay C-1 with relays in box I for a brief instant sufficient to allow one of the five relays in that box to be selected and locked. As soon as this occurs, column relay C-1 releases and transfers the scrambler 67 to the second set of code relays II by way of column relay C-2. This action continues until one relay in each box I to IV has been selected and locked. The column relays C-7 to C-10 operate in a similar manner during the succeeding half cycle of the distributor to associate the scrambler 67 with the relays in boxes VII to X and cause a relay in each box to be selected and locked. As explained in detail in the Busch-Cahill-Myers application, only certain of the code designations produced by the scrambler 67 can be used since the selection must be restricted to those which do not result in repetition of the same speech element a plurality of times or in the dropping out of one or more of the speech elements. It is the function of the exclusion relay XI to modify where necessary the code designations produced by the scrambler 67 and to insure that only those code relays are selected and locked which will meet the two stated requirements of no repetition of the same element and no omission of any element.

As disclosed in detail in the Mitchell application, each of the switching circuits 75 includes a relay which is actuated whenever a ground is projected from brush 72 over one of the distributor segments and through a closed contact of an actuated code relay and over one of the leads A, I to the corresponding switching circuits 75. A transmitting conductor 55' and a receiving conductor 57' are shown as extending into each of the switching circuits 75. Whenever the relay in a switching circuit 75 is energized it connects the corresponding heads A to I to one or the other of the circuits 55' or 57' depending upon whether the station is being used for transmitting or receiving. The switch-over from transmit to receive is effected by a push-to-talk key 77, the arrangement being such that when the button or key 77 is released the circuit is in the receiving condition and when the button is actuated the circuit is in the transmitting condition. A lead 77' is shown connecting the key 77 with each one of the switching circuits 75 which are assumed to contain a relay (as in Mitchell) for determining whether a corresponding head A to I when selected for use is to be connected to circuit 55' or to circuit 57'.

So far as the first privacy above described is concerned, the operation is in brief as follows: When the user desires to speak over the system he presses the button 77, conditioning all of the switching circuits 75 to connect the heads A to I individually to the transmitting branch 57' whenever such heads are selected during the coding process. The switch springs 58 are also thrown to their alternate or lower position in the transmitting condition under control of the button 77 (by means not shown), connecting transmitting circuit 55' to outgoing terminal 55 and severing connection between receiving terminal 57 and receiving circuit 57'.

Speech spoken into the microphone is recorded on the tape 62 and as the brush 72 traverses the distributor segments the heads A to I are brought into circuit individually for definite time intervals as determined by the distributor and in an irregular order as determined by the settings of the code relays. In this way, speech broken up into time fragments and rearranged in abnormal time order is sent out over the circuit 55. When secret speech comes in over circuit 57 and is to be decoded and received, switch 77 is in its normal position extending a circuit from terminal 57 to conductor 57' and conditioning the switching means 75 to connect the heads A to I individually and in selected order to the conductor 57'. The order of connection is determined by the settings of the code relays as determined by the scrambler 67 with the aid of the exclusion relays XI. Since the scrambler 67, code relays, exclusion relays and other circuits concerned with the setting up of the code are an exact duplicate of those used at the distant sending station and are operated in accurate synchronism therewith, the code set up on the code relays will be of such character as to produce on the tape 62 a record of normal speech corresponding to the message sent from the distant terminal. As the tape passes the reproducing head 56, therefore, the normal speech is heard in receiver 65.

The second privacy will now be briefly described on the assumption that the reader is familiar with the disclosure of Chesnut-Fisher-Sanial U.S. Pat. No. 1,829,783, Nov. 3, 1931. As disclosed in that patent, speech currents are divided on a frequency basis by narrow band filters into a number of subranges or subbands. The actual number of subbands used can be varied so far as the invention is concerned and might be four or five or some other number. In harmony with the patent disclosure, however, it will be assumed that the speech band is divided into four subbands by the means shown in the patent and that sources of continuous waves of appropriate frequencies together with modulating and switching circuits are provided for enabling these bands to be interchanged among themselves either with or without a simultaneous inversion of frequencies within any subband. In the Chesnut-Fisher-Sanial system provision is made for changing the scheme of frequency shift from time to time under control of a timing mechanism, each scheme of frequency shift being determined by actuation of a single relay of which five are reproduced in the figure as relays 101, 102, 103, 104 and 105, these corresponding to the similarly numbered relays in FIG. 4 of the patent. Relay 101, for example, is provided with eight armatures and as clearly explained in the patent when this relay is energized and when ground is applied to each of these eight armatures, other relays disclosed in detail in the patent are energized and are caused to effect circuit changes determinative of a particular pattern of frequency shifts to be used for the four subbands to produce a certain type of scramble. Similarly, if relay 102 is energized and if ground is applied to each of those armatures (not shown), other relays as disclosed in the patent are operated to effect a different type of frequency scramble. Five such different scrambles are chosen for illustration in the present application and are represented by the five code relays 101 to 105.

As shown in FIG. 1 of the Chesnut-Fisher-Sanial patent the secrecy system 4 is used for both transmitting and receiving by causing the waves in both cases to pass through the privacy system in the same direction, from left to right, with the aid of hybrid coils (not shown) and four switching relays 18, 19, 20 and 21, as shown also in FIG. 2 of this application. The normal condition of the system is the receiving condition in which case all four relays 18 to 21 are unenergized. Waves incident upon the receiving antenna 1 are transmitted to the radio receiver 2 and through the privacy 4 in the direction from left to right in a manner shown in the patent and thence into a voice line which, in the present application disclosure, is terminal circuit 57.

In the Chesnut-Fisher-Sanial patent, in the transmitting condition voice waves are diverted into a rectifier circuit to cause actuation of the four switching relays 18 to 21 which then serve to disable the receiving side and to enable the transmitting side of the circuit. In the present disclosure, since the first privacy employs a push-to-talk button, these four switching relays 18 to 21 are actuated in the transmitting condition directly from the key 77 over conductor 79. The signals to be transmitted are then impressed on terminal circuit 55 and are caused to traverse the privacy 4 in a direction from left to right and thence to pass into the radio receiver 17 for transmission to the distant station.

The actuating circuits shown in the patent for the code relays 101, etc., and involving the use of cams and relays, are replaced in the present disclosure by the five conductors V, W, X, Y, Z which are connected to extra contacts on the code relays in each of the boxes I to IV and VII to X. Whenever the corresponding code relay armature or combination of relay armatures are attracted ground is applied to one of these five conductors V, W, X, Y, Z and directly causes actuation of the corresponding relay 101 to 105. Each of these code relays has all of its eight armatures permanently connected to ground so that in the present disclosure it is only necessary to actuate one of these code relays to cause immediate operation of the necessary circuit controlling relays in accordance with the patent disclosure to effect the corresponding frequency scramble.

The grounds that are supplied through the extra armatures and contacts of the code relays to the conductors V to Z are derived in the first instance from grounds 80 shown adjacent each of the nine switching circuits 75. Each of the switching relays in the boxes 75 referred to above for switching in the heads A to I carries a special armature for the purpose of extending a ground 80 through such extra armature, when the corresponding relay is operated, to one of the nine leads a to i. These conductors are in turn carried through the extra contacts spoken of above on the code relays and eventually to the five conductors V to Z.

Figure 3:
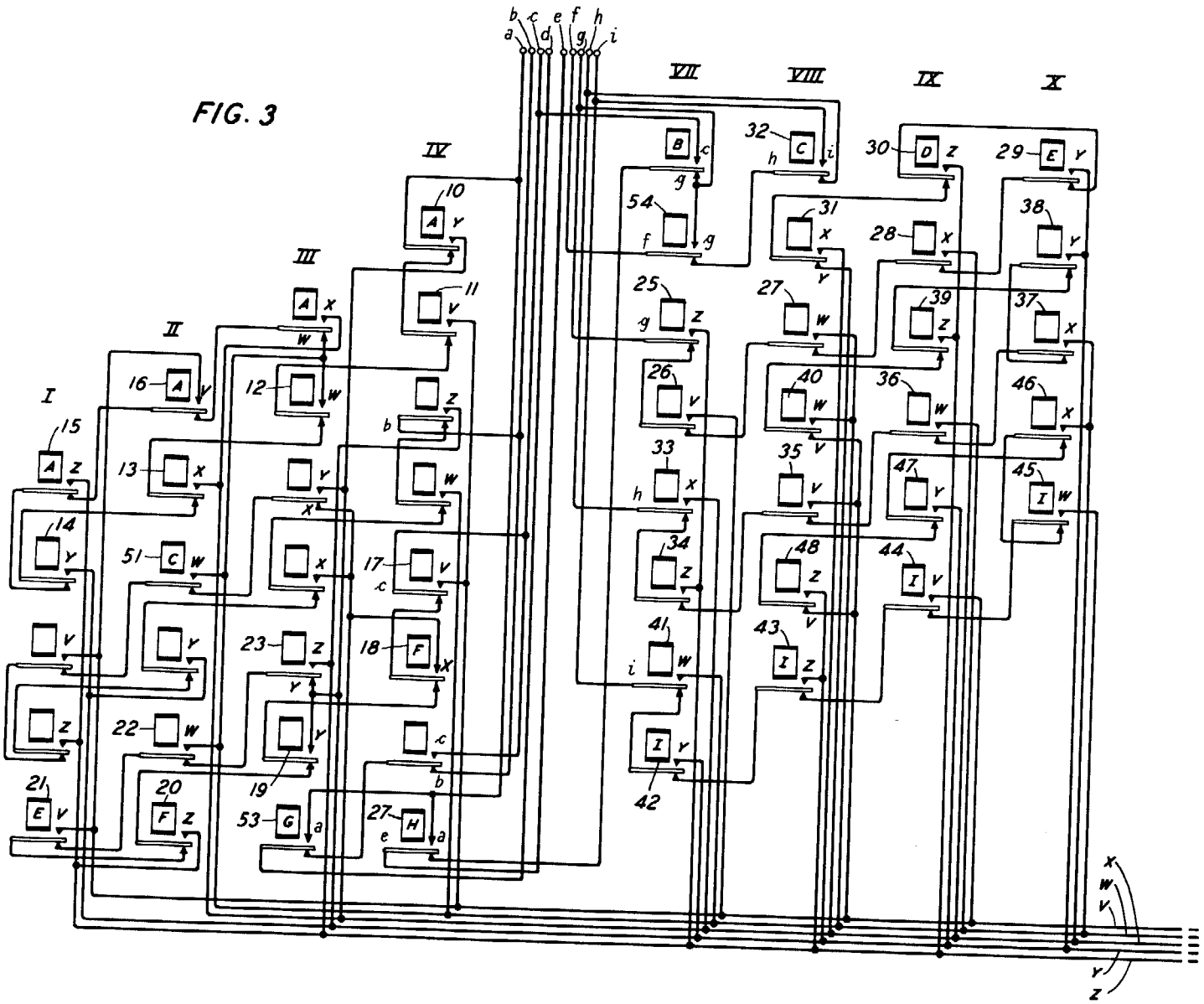
FIG. 3 is a schematic wiring diagram for the code relays to be used in the first privacy system with connections for also controlling the second privacy system.

FIG. 3 indicates by way of example how the nine leads a to i may be wired through extra armatures and contacts on the code relays to supply actuating grounds to the leads V to Z. In this figure the code relays in the various boxes are shown arranged to columns I to IV and VII to X corresponding to the different boxes in FIG. 2. Each of these code relays actually has a plurality of armatures that are used for carrying out their code selecting functions, etc., as disclosed in the Busch-Cahill-Myers application. Those armatures are omitted from FIG. 3 for simplicity and only the extra armatures are shown which are to be supplied over and above those shown in the Busch-Cahill-Myers application in order to practice the present invention.

It is desired to provide a type of wiring such that given codes used in the second privacy system will not be associated with certain of the switching circuits 75 of the first privacy system, since such association might be of aid to an outsider in obtaining a clue for the solution of the first privacy scramble. In accordance with this invention the conductors a to i leading from grounds controlled by the switching circuits 75 are carried through transfers on the code relays in such manner that no one of the five code relays 101 to 105 is associated with any particular switching circuit 75 but is shifted from one circuit 75 to the next in an irregular fashion as determined by the code relays. A scheme of connections through the armatures of the code relays for accomplishing this purpose is given in detail in FIG. 3.

In describing these connections a simple example will be taken in which it is assumed that in the commutator times 1, 3, 5, 7 and 9, speech fragments are sent in the time order 5, 4, 1, 3, 2 where their occurrence in normal speech is 1, 2, 3, 4, 5. In order to send the speech fragments out in the assumed order, it is necessary to connect certain of the heads A to I into circuit in the order A, C, G, F, H. This requires actuation of the code relays 15, 51, 53 and 18, the fifth selection (of head H) being determined by the exclusion relay circuit. The order in which grounds are applied to certain of the conductors a to i is a, c, g, f and h. Tracing these grounds, first from conductor a, a circuit extends through normal contacts of relays 10, 11, 12, 13 and 14 and through front contact of relay 15, and thence, since the code in this example requires 15 to be operated, to conductor Z. Tracing the c lead this extends through normal contacts of relay 17 and front contact of relay 18, since 18 is operated in this example, to conductor X. Tracing the ground from conductor g this extends through normal contacts of relays 25, 26, 27, 28, 29, 30 and 31 to conductor Y on the assumption that none of these latter relays is operated. Operation of any one of the relays changes the selection. For example, if relay 25 were operated, conductor Z will be selected. If relay 26 instead were operated, conductor V will be selected, etc. Tracing conductor f this passes through normal contacts of relays 54 and 32 to conductor h, thence through normal contacts of relays 33, 34, 35, 36, 37, 38, 39 and 40 (unless one of the relays in this chain is operated) to either conductor V or W depending upon whether relay 40 is unoperated or operated. In the next time interval conductor h again is used since this is the conductor on which a ground is placed as a result of choosing head H in this time interval. If conductor i, for instance, were the one grounded, this conductor would extend ground to normal contacts of relays 41, 42, 43, 44, 45, 46, 47 (unless one of these is actuated) and 48 which would select conductors Z or V depending upon whether this relay is energized or not.

The invention is not to be construed as limited to the detailed disclosure, which is intended as illustrative, but the scope is defined in the claims.

What is claimed is:

1. In a speech transmission system, a first privacy apparatus for making reversible alterations in speech message waves for rendering unauthorized reception of the message difficult, a second privacy apparatus for making a different kind of reversible alterations in the speech message waves for increasing the difficulty of unauthorized reception of the message, a common coding mechanism for controlling the alterations made in both privacy apparatuses, said coder supplying control potentials to the first of said privacy apparatuses, and means in said first privacy apparatus for translating said control potentials into control potentials of different character for controlling said second privacy apparatus.

2. In a signaling system, two privacy systems in tandem for successively effecting two different transformations in signal waves to be transmitted, each privacy system including coding mechanism for altering the character of the transformation effected by the respective privacy system from time to time, control circuits for variably controlling the coding mechanism of one of said privacy systems, and means in the coding mechanism of the other privacy system for altering the action of said control circuits.

3. In a signaling system, two privacy apparatuses connected in tandem for successively operating upon signals to alter their character in two different ways prior to transmission, each privacy apparatus including a coding mechanism for determining the character of the alteration introduced in the signals by the respective privacy apparatus and for changing the character of such alteration from time to time, means for variably initiating control currents under control of one privacy apparatus, means for causing the coding mechanism of said last-mentioned privacy apparatus to alter the character of said control currents and means to use said control currents so altered to determine the operation of the coding mechanism of the other privacy apparatus.

4. In a signaling system, a first privacy system comprising means to subdivide signals on a time basis into short segments and coding means to rearrange said segments into abnormal time sequence to obscure the message content, a second privacy system, means to impress the output of the one of said privacy systems upon the input of the other privacy system, said second privacy system comprising means for subdividing the signals on a frequency basis into a plurality of narrow subbands of frequency and coding means to rearrange said subbands into abnormal frequency relationships to further obscure the message content, means in each privacy system for automatically changing the rearranging scheme of said segments or subbands from time to time, means to supply control currents to control the operation of said last means and means to pass the control currents for one of said privacy systems through paths controlled by the coding means of the other privacy system.

5. In combination in a speech privacy system in which the speech is divided and rearranged in accordance with a time function to reduce its intelligibility and in which the speech is separately divided and rearranged on a frequency basis to also reduce its intelligibility, a code generating means for controlling both types of privacy and means to guard against discovery of the nature of the code by using one of the privacy equipments to modify the code control over the other privacy equipment.

6. The invention according to claim 4 in which one of said privacy equipments includes coding relays and means to pass the code controls for the other privacy through contacts of said relays in variable manner.

7. The invention as claimed in claim 6 in which the second of said privacy equipments also includes relays and a control lead for each relay extending through one or more relay contacts of the first privacy.

* * * * *